US005388701A

United States Patent [19]

Ridgeway

[11] Patent Number: 5,388,701

[45] Date of Patent: Feb. 14, 1995

[54] SUSPENSION PACKAGING

[75] Inventor: Devin C. Ridgeway, Chula Vista, Calif.

[73] Assignee: Sealed Air Corporaiton, Saddle Brook, N.J.

[21] Appl. No.: 155,710

[22] Filed: Nov. 22, 1993

[51] Int. Cl.[6] ..... B65D 85/30

[52] U.S. Cl. ..... 206/583; 206/594

[58] Field of Search ..... 206/521, 583, 586, 591, 206/594, 328, 305, 320

[56] References Cited

U.S. PATENT DOCUMENTS

| | | | |
|---|---|---|---|
| 2,134,908 | 12/1935 | Copeman . | |
| 2,501,570 | 3/1950 | Larsen . | |
| 2,681,142 | 6/1954 | Cohen . | |
| 2,811,246 | 10/1957 | Sloane . | |
| 3,221,872 | 12/1965 | Wood . | |
| 3,404,827 | 10/1968 | Carmody . | |
| 3,487,921 | 1/1970 | Barth et al. . | |
| 3,521,743 | 7/1970 | Sposito, Jr. . | |
| 3,552,595 | 1/1971 | Gerner et al. . | |
| 3,669,337 | 6/1972 | Struble . | |
| 3,692,264 | 9/1972 | Burkhard et al. . | |
| 3,752,301 | 8/1973 | Bluemel . | |
| 3,853,220 | 12/1974 | Luray . | |
| 4,027,794 | 6/1977 | Olson . | |
| 4,087,003 | 5/1978 | Adamek . | |
| 4,491,225 | 1/1985 | Baillod . | |
| 4,606,459 | 8/1986 | Luray . | |
| 4,606,460 | 8/1986 | Luray . | |
| 4,759,444 | 7/1988 | Barmore . | |
| 4,852,743 | 8/1989 | Ridgeway . | |
| 4,865,200 | 9/1989 | Sullivan et al. | 206/594 X |
| 4,903,827 | 2/1990 | Phelps et al. | 206/583 X |
| 4,923,065 | 5/1990 | Ridgeway . | |
| 5,056,665 | 10/1991 | Boecker et al. . | |
| 5,071,009 | 12/1991 | Ridgeway . | |
| 5,218,510 | 6/1993 | Bradford | 206/583 X |
| 5,251,760 | 10/1993 | Smith et al. | 206/583 |

FOREIGN PATENT DOCUMENTS

| | | |
|---|---|---|
| 2723175 | 11/1978 | Germany . |
| 3340155 | 4/1984 | Germany . |
| 53-135796 | 11/1978 | Japan . |
| 475299 | 11/1937 | United Kingdom . |
| 827346 | 5/1981 | U.S.S.R. . |

OTHER PUBLICATIONS

Proposal by Sealed Air Corporation of earlier version of suspension packaging.

*Primary Examiner*—Jacob K. Ackun, Jr.
*Attorney, Agent, or Firm*—Bell, Seltzer, Park & Gibson

[57] ABSTRACT

A package for fragile articles is disclosed and comprises a container that forms a solid polygon and two suspension frames in the container. Each of the frames are formed of a plurality of upright side panels and have at least one dimension that substantially spans and abuts the interior of the container so that each frame is prevented from moving in the container. At least two of said side panels are parallel, and each of which forms an arch, so that the arched parallel side panels are opposite one another. A resilient membrane is attached tightly to the edges of the side panels of each frame, and extends from the base of each arched side across the rise and span of each arched side. The frames are positioned in the container with the membranes in face to face relationship for holding an object suspended therebetween.

22 Claims, 4 Drawing Sheets

10
4
5

11
12
14
24
16
31
17

20
21
13
32
23
27
22
26
23
33

SUSPENSION PACKAGING

FIELD OF THE INVENTION

The present invention relates to suspension packaging, and particularly relates to the type of suspension packaging in which a frame supports a flexible film material and is placed in face-to-face relationship with another such frame inside a container to form a suspension package.

BACKGROUND OF THE INVENTION

Suspension packaging is a form of packaging in which an object to be packaged, usually a fragile one, is suspended within a container, typically using some sort of flexible, resilient material, and maintained out of contact with the rigid portions of the overall container. Because the material is flexible and resilient and the object is out of contact with the rigid portions of the container, the object is thereby protected to some greater or lesser degree from physical shock.

One useful form of suspension packaging is illustrated in U.S. Pat. No. 4,852,743 issued to Louis H. Ridgeway which describes a useful and straightforward system for packaging fragile objects, particularly in solid rectangular containers such as a conventional corrugated board ("cardboard") box. In the '743 patent, the suspension package is formed by two sheets of plastic film material in face-to-face relationship. The sheets are in turn attached to frames which, because they have flaps attached to them, will when placed within a desired sized box, be spaced to fit and hold the object between the plastic sheets. The resulting packages have a number of advantages. First, because they can be formed of corrugated board and relatively inexpensive plastic sheet material, they offer a low cost packaging alternative. Additionally, the frames can be formed in planar fashion and cut as a "blank" and shipped to packaging customers and then stored in that form for assembly by the packager as desired.

As illustrated in the Ridgeway '743 patent, a suspension package attempts to hold an object securely by using the tension that the resilient plastic sheets apply to the object as they are stretched out of a planar orientation by the object placed between them. The extent to which the object forces the sheets out of a planar orientation is sometimes referred to as the "pitch" or the "deflection" of the plastic film. As might be expected, under many circumstances, the greater the pitch, the greater the holding force applied to the packaged object.

The dimensions of thinner objects, however, tend to create less pitch in a suspension package of the type illustrated in the Ridgeway '743 patent. This lack of pitch is compounded by the fact that the frames, and thus the plastic sheets, necessarily abut one another in a face-to-face relationship in a typical suspension package. As a result, such thinner objects, when packaged in a suspension package, have a greater tendency to slip when a sudden force is applied to the container (i.e., when dropped) than do objects that force the plastic film material into a greater pitch.

Nevertheless, the other advantages of suspension packaging are such that obtaining a method of using it with objects that develop less pitch remains a desired packaging goal.

OBJECT AND SUMMARY OF THE INVENTION

Therefore, it is an object of the present invention to provide a suspension package that will successfully hold thinner objects in place and limit their movements even when such objects are small enough to prevent ordinary suspension packaging from developing the necessary pitch.

The invention meets this object with a suspension frame and resulting package for fragile articles which comprises a container that forms a solid polygon and two suspension frames in the container. Each of the frames is formed of a plurality of upright side panels and has at least one dimension that substantially spans and abuts the interior of the container so that each frame is prevented from moving in the container. Each frame further comprises at least one set of two parallel side panels, each of which forms an arch so that the arched parallel side panels are opposite one another. A resilient membrane is attached tightly to the edges of the side panels of each of the frames and extends from the base of each of the arched sides across the entire rise and span of each of the arched sides. The frames are positioned in the container with the plastic film of each frame in face-to-face relationship for holding an object suspended therebetween.

The foregoing and other objects, advantages and features of the invention, and the manner in which the same are accomplished, will become more readily apparent upon consideration of the following detailed description of the invention taken in conjunction with the accompanying drawings, which illustrate preferred and exemplary embodiments, and wherein:

DETAILED DESCRIPTION

Figures 1, 2, 3:
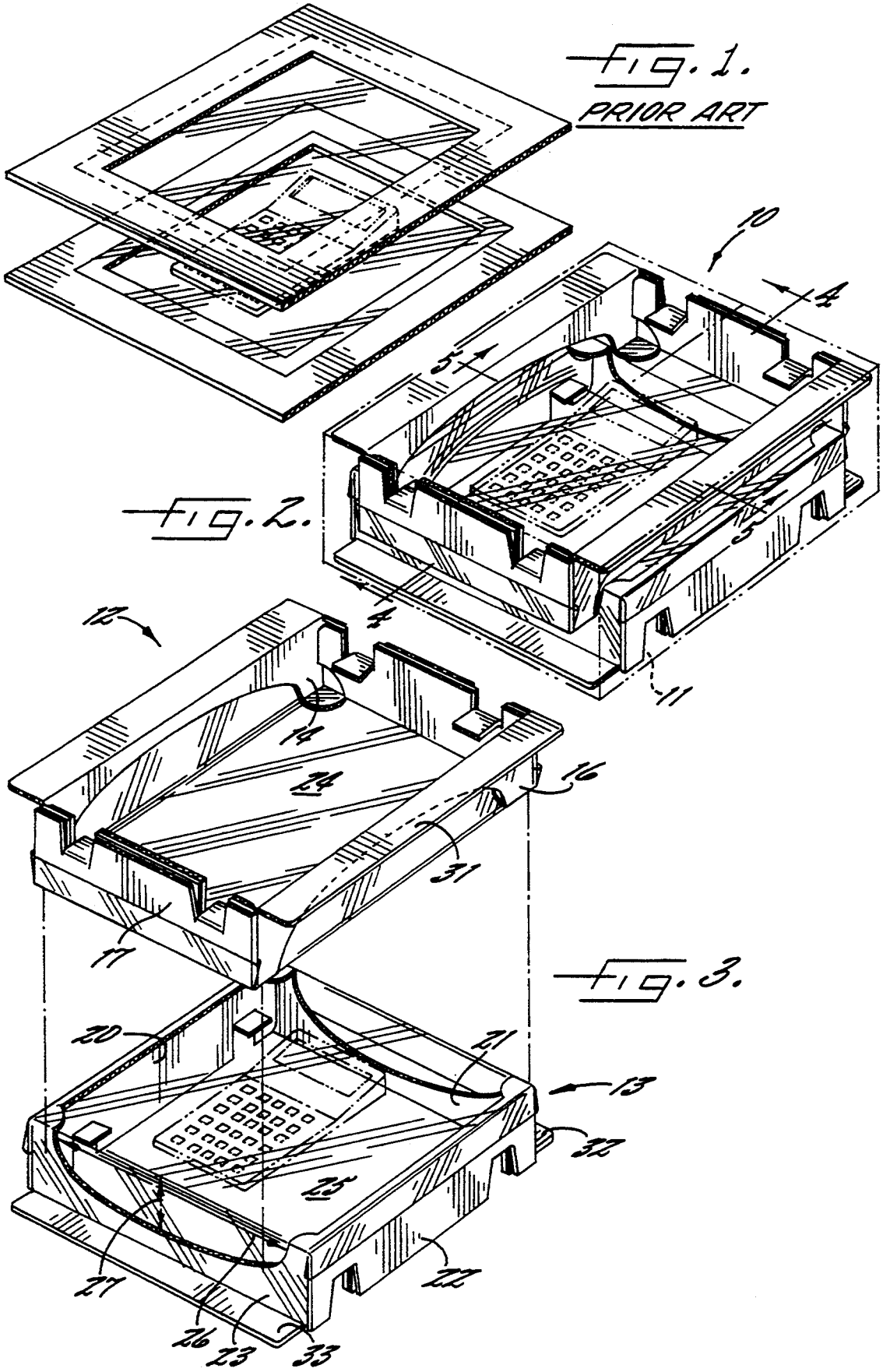
Fig. 1. PRIOR ART
FIG. 1 is a perspective view of a prior art suspension packaging system.
FIG. 2 is a perspective view of an assembled container and suspension frames according to the present invention.
FIG. 3 is an exploded view of two of the suspension frames of the present invention in a typical relationship.
Figure 4:
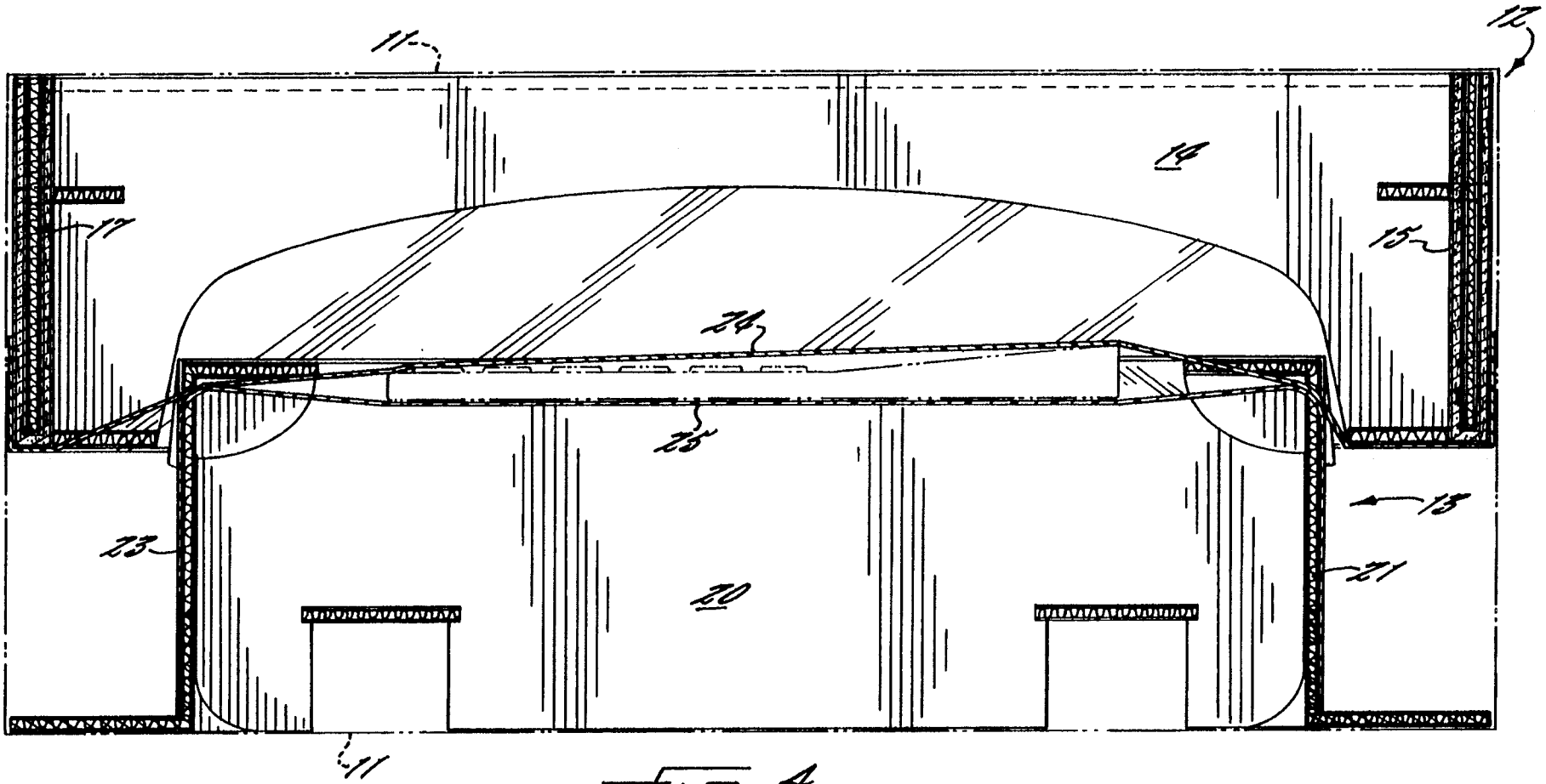
FIG. 4 is a cross-sectional view taken along lines 4—4 of FIG. 2.
Figure 5:
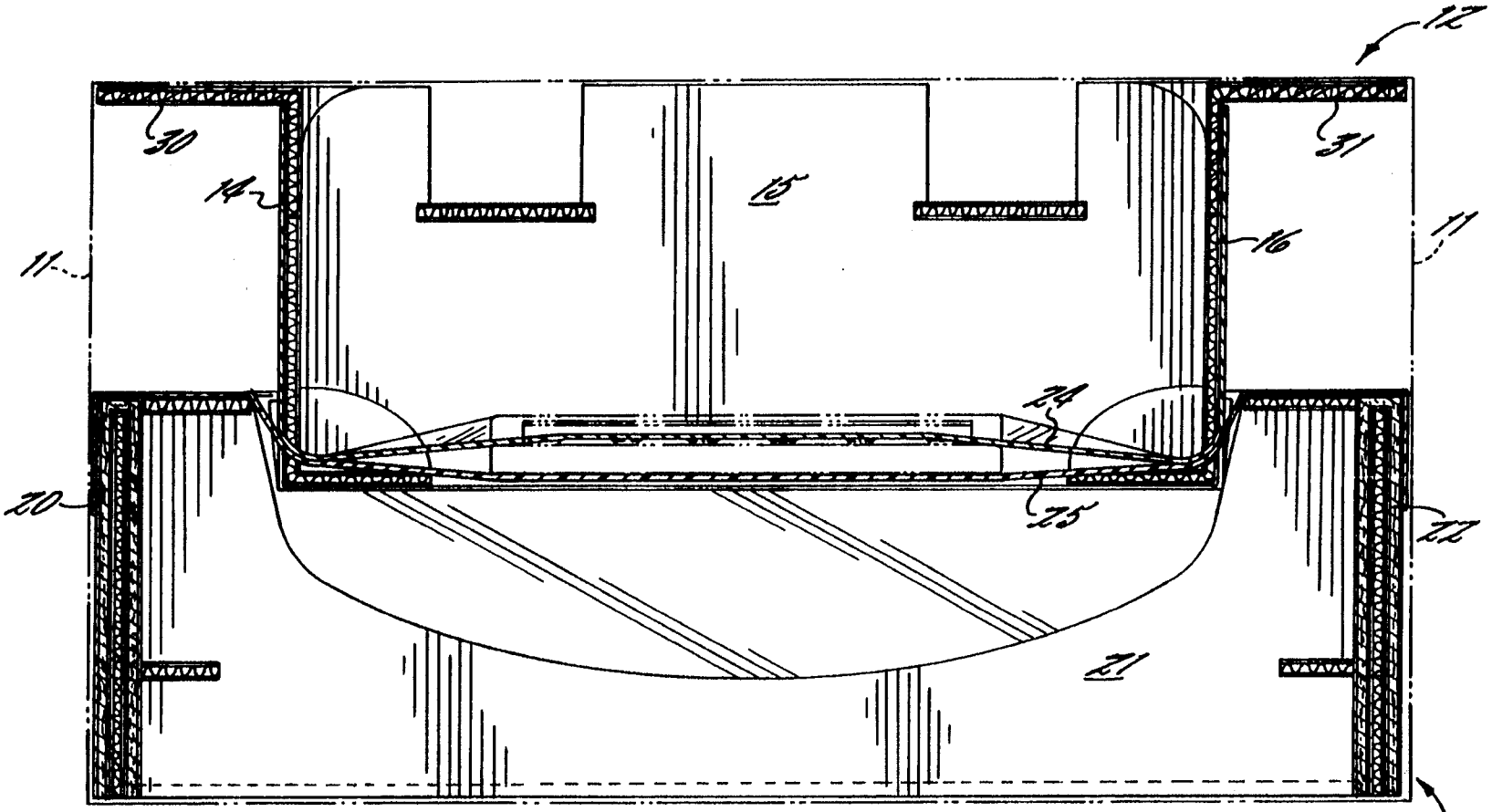
FIG. 5 is a cross-sectional view taken along lines 5—5 of FIG. 2.

The present invention is a package that is particularly suitable for fragile articles and which is designated broadly in FIG. 2 at 10. The package includes a container 11 which in FIGS. 2, 4, and 5 is shown in dashed lines in order to more clearly illustrate the structure of the suspension frames to be described herein. The container generally forms a solid polygon of which the most common shape is a conventional square or rectangle. It will be recognized, of course, that other solid polygonal shapes or even non-polygonal shapes such as cylinders could form the containers of the present invention, but are generally much less common, even though they would still fall within the scope of the claims herein.

The package further comprises two suspension frames broadly designated at 12 and 13 respectively. Each frame is formed of a plurality of upright side panels. The side panels of frame 12 are designated herein as 14, 15, 16, and 17 respectively, and those of frame 13 as 20, 21, 22, and 23 respectively. As illustrated in FIG. 2, the frames each have at least one dimension that substantially spans and abuts the interior of the container 11 so that the container 11 prevents each frame from moving at least laterally when in the container 11. FIGS. 2 and 3 illustrate that because the most common form of the container is a solid rectangle, the side panels of the frames 12 and 13 each likewise form a rectangle.

In the frames 12 and 13, at least two of said side panels are parallel, and each of which forms an arch so that the arched parallel side panels are opposite to one another. FIG. 3 illustrates that in frame 12, the parallel arched side panels are the panels 14 and 16, and in the frame 13, the arched panels are the panels 21 and 23. As used herein, the term "arch" is applied in its usual sense. One definition, although not a limiting one, is that of a typically curved structural member spanning an opening and serving as a support. An arch can be considered to have certain structural sub-features such as its piers, springers, rise, span, and other related parts. The rise is the distance from the base of the arch to its point that would correspond to a keystone in a building structure, while the span is the distance between the two piers at which the arch begins. It will be understood that these terms are used descriptively to help explain and illustrate the structure and function of the present invention, and not as terms of limitation.

Each of the frames 12 and 13 further includes a resilient membrane illustrated as a sheet of flexible plastic film at 24 in frame 12 and at 25 in frame 13. The plastic film 24 and 25 is attached tightly to the edges of the side panels 14–17 and 20–23 of each frame and extends from the base of each of the arched sides 14, 16 and 21, 23 across the potions of the rise and span of each of those arched sides. For purposes of clarity and illustration, the span of arched side 23 of frame 13 is designated at 26 and the rise at 27. As illustrated, the plastic film membranes 24 and 25 extend entirely across the rise and span, but in other circumstances may extend only partially across and leave some of the arch uncovered.

As illustrated by FIGS. 2, 4, and 5, the frames 12 and 13 are positioned in the container 11 with the plastic films 24 and 25 in face-to-face relationship for holding an object (illustrated in phantom lines as a small calculator) suspended therebetween. More specifically, in preferred embodiments, the arched side panels 14 and 16 of frame 12 are positioned perpendicularly to the arched side panels 23 and 21 of frame 13 when the frames are in the container.

It will thus be understood that the arched sides serve at least two purposes. First, they allow a thinner object to create a greater pitch when the object is suspended between the two frames because they allow the frames to overlap one another in their face-to-face relationship in the container. If the arched openings in sides 14, 16, 21, and 27 were not present, the frames 12 and 13 would be limited to an abutting relationship as illustrated in FIG. 1 which shows one version of the typical prior art.

As a second function, the arches provide structural support that gives the frame greater rigidity, particularly in the overall package 10. By way of explanation, if sides 14, 16, 21, and 23 were simply opened, cut out, or even eliminated, they would fail to give sufficient structural support to the frame as a whole, and indeed could lessen the overall structural support provided by the frames. For example, if stress were placed on sides 15 and 17 of frame 12—i.e., by placing an object between the plastic sheets 24 and 25 and then fixing frames 12 and 13 in a closed container—they would have a tendency to collapse inwardly. The arched shapes of sides 14, 16, 21, and 23, however, provide a structural stability that prevents the opposing perpendicular sides 15, 17, 20, and 22 from folding in upon themselves under the weight of a suspended object, or the force exerted by a closed package, rather than suspending the object in the manner provided by the arches.

As an additional advantage, when the frames are placed perpendicularly to one another, they provide a pitch of plastic material in all four directions around the object suspended between them thus greatly minimizing, and in many cases eliminating, the possibility that a suspended object can move in the overall package regardless of the manner in which the package may be treated; i.e., dropped.

FIG. 3 also illustrates that the frames can have different dimensions from one another in order to package differently shaped objects. In FIG. 3, frame 12 has a more rectangular profile while frame 13 has a more square profile. In particular, the frames 12 and 13 differ in length along the respective arched sides; i.e., arch sides 14 and 16 having a different dimension from arched sides 21 and 23. It has been determined, according to the present invention, that by using different dimensioned frames, the overall size of the external container 11 can be customized and in many cases minimized with respect to the article being packaged therein. Obviously, a smaller sized package for a given object offers a multitude of efficiencies including lower costs for materials, and less space required during storage, transportation, and other handling.

In a preferred embodiment illustrated in the drawings, and perhaps best seen in FIG. 3, the frames further comprise spacer feet 30 and 31 on frame 12 and 32 and 33 on frame 13. These help minimize the space required of the frames 12 and 13 and add to their convenience and efficiency by providing the portion of the frame that abuts the side walls of the container. The feet 30, 31, 32, and 33 extend perpendicularly along at least one side panel edge opposite the edges from which the plastic film 24 or 25 extends. The feet also serve to permit the frames to desirably overlap when oriented perpendicularly to one another by positioning the respective arched sides inwardly of the interior walls of the container 11.

As mentioned earlier herein, one of the advantages of the invention is that the frames can be made of corrugated board and a plastic film formed from an appropriate polymer chosen for its tensile strength and stretchability, preferred plastics being polyurethane and polyvinyl chloride (PVC), or other polymers with equivalent properties. As perhaps best illustrated in FIGS. 4 and 5, a typical corrugated board is formed of a corrugated kraft paper lined on both sides by kraft paper sheets.

Polyurethane and polyvinyl chloride are a good choice for the resilient membrane because the films offer the properties desired in a suspension package: flexibility, resilience, durability, and tear and puncture resistance. Flexibility permits the membrane to receive the object to be packaged, while resilience provides the force required to hold the object in place. Tears or punctures would diminish the quality of the resulting package, and in some cases cause complete failure. Accordingly, it will be understood that although plastics such as polyurethane or PVC are presently preferred, other membrane materials (whether available now or in the future) could provide equivalent performance.

In another embodiment, the invention comprises the suspension frame itself. Referring again to frame 12, it is formed of a plurality of upright side panels 14, 15, 16, and 17, with at least two of the side panels 14 and 16 being parallel, and each of which forms an arch so that the arched parallel side panels 14 and 16 are opposite one another. The sheet of flexible plastic film 24 is attached tightly to the edges of the side panels of the frame. In a rectangular frame such as illustrated in FIG. 3, the plastic film material will generally be attached to all four sides, but it will be understood that this might not be necessary in all circumstances. For example, where the frame was a hexagonal or octagonal, the plastic material might not need to be attached to all six or all eight sides. As stated earlier, the sheet 24 extends from the base of each of the arched sides 14 and 16 across the entire rise and span of each of the arched sides.

As in the earlier embodiment, the most common and preferred shape of the frame is a rectangle, with the frame being formed of corrugated board and either polyurethane or polyvinyl chloride and includes the spacer feet 30 and 31 extending perpendicularly for abutting the walls of a container such as 11 when the frame 12 is place therein.

Figure 6:
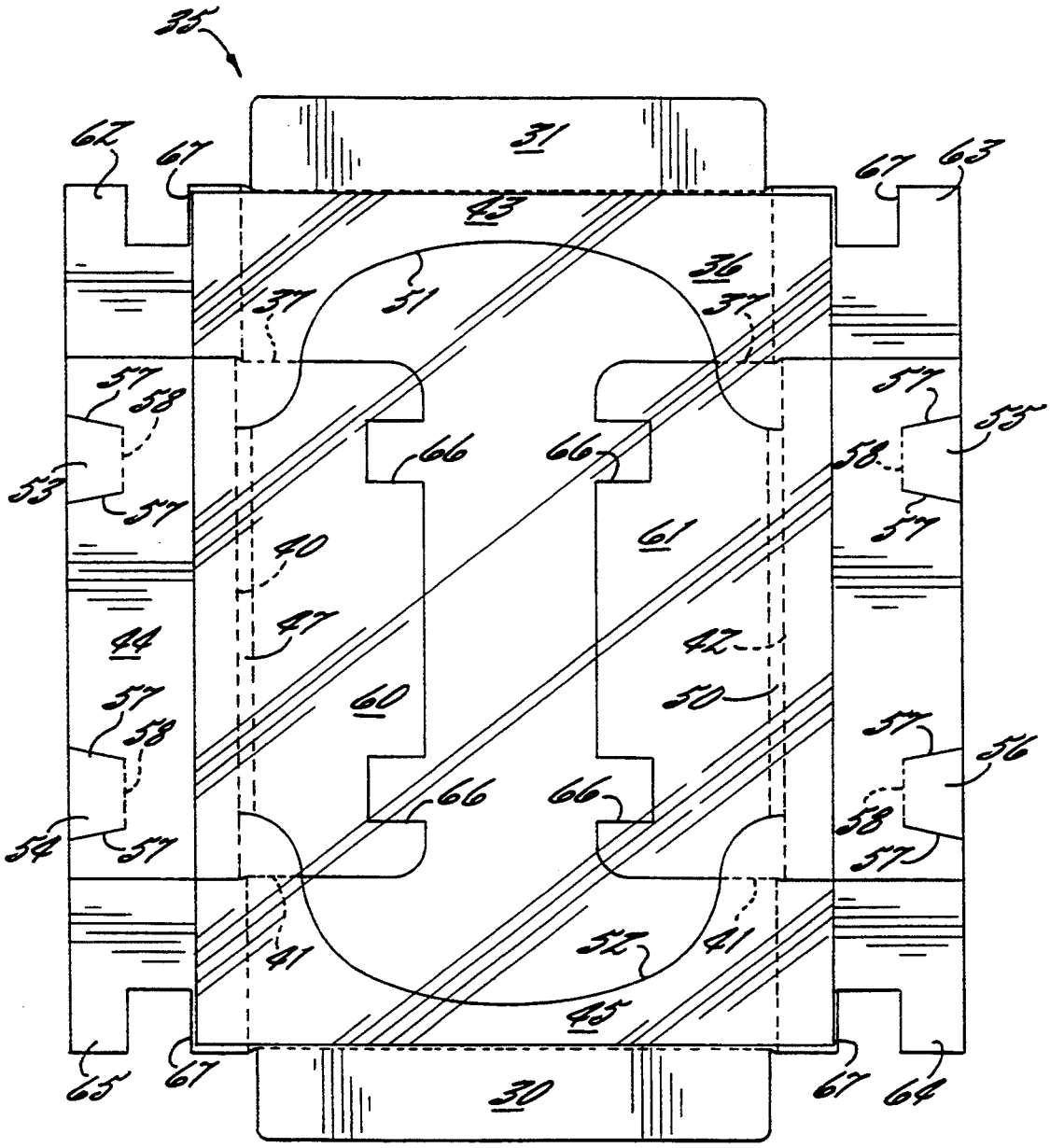
FIG. 6 is a top plan view of a blank that can be folded and assembled to form a suspension frame according to the present invention.

In yet another embodiment, the invention comprises a corrugated board blank generally designated at 35 in FIG. 6 for forming a suspension frame for packaging fragile objects. In other words, in many situations, the party wishing to use the packaging of the present invention can obtain the blanks in unfolded flat arrangement so that many such blanks can be shipped and stored in much less space than they occupy when used to do packaging. The blank comprises a substantially rectangular planar sheet of corrugated board 36. FIG. 6 illustrates that although the perimeter of the sheet 36 may include various cutouts, the overall profile is best described as a rectangle. The sheet 36 includes a series of fold lines for defining four flap precursor portions along the four edges of the rectangular sheet. In FIG. 6, the four basic fold lines are shown at 37, 40, 41, and 42. These define the four flap precursors 43, 44, 45, and 46.

A central opening is defined by the corrugated board sheet 36 and is best illustrated by its two parallel side portions 47 and 50 (which, in the embodiment illustrated in FIG. 6, are coincident with fold lines 40 and 42) and two opposing side portions 51 and 52. A sheet of flexible plastic film, again preferably polyurethane, polyvinyl chloride, or another polymer with equivalent properties, covers the central opening and is attached to the planar corrugated board sheet by any appropriate method, preferably an adhesive that will secure the selected plastic to corrugated board.

FIG. 6 illustrates that in order to form a frame such as those illustrated in FIGS. 2–5, the parallel side portions 47 and 50 of the central opening are positioned adjacent the fold lines 40 and 42, and the curved end portions 51 and 52 extend beyond two of the fold lines 37 and 41.

In preferred embodiments, the blank 35 further comprises a plurality of cut and scored tab precursor patterns formed by another set of respective fold lines, scored lines, and cut lines for forming tabs that hold the blank 35 as a suspension frame when the blank 35 is folded and the tabs are detached along the score lines and likewise folded. In the embodiment illustrated in FIG. 6, four tab precursors are illustrated at 53, 54, 55, and 56. The cut lines, where the corrugated board is intended to separate, are illustrated at 57 and the fold lines at 58 for each of these tab precursors.

The blank 35 can also include a pair of interior flap precursors 60 and 61 and four corner portions 62, 63, 64, and 65 which when folded form the frame embodiments illustrated in FIGS. 2 and 3. The interior flap portions 60 and 61 include cutouts 66 and the corner portions include cutouts 67. It will be seen from a comparison of FIG. 6 with FIG. 3, for example, that when the portions 60 and 61 are folded adjacent the flaps 44 and 46, and the corner portions 62, 63, 64, and 65 are likewise folded in, the tabs 53, 54, 55, and 56 lock all of these together to form the structural frame.

It will be understood of course, that the respective folds and tabs represent only one technique for forming the frame, and that adhesives, adhesive tapes, friction locks, or any other suitable technique would form an equivalent structure.

Finally, FIG. 6 also illustrates the spacer feet which are labeled at 30 and 31 for the sake of clarity with respect to FIG. 3 and FIG. 6 when taken together.

In the drawings and specification, there have been disclosed typical preferred embodiments of the invention and, although specific terms have been employed, they have been used in a generic and descriptive sense only and not for purposes of limitation, the scope of the invention being set forth in the following claims.

That which is claimed is:

1. A package for fragile articles and comprising:

a container that forms a solid polygon and two suspension frames in said container, each said frame being formed of a plurality of upright side panels and having at least one dimension that substantially spans and abuts the interior of said container so that each said frame is prevented from moving in said container;

at least one of said frames having two parallel side panels, and each of which defines an arch therein, so that said arched parallel side panels are opposite one another, and a resilient membrane attached tightly to said side panels of each said frame, and extending from the base of the arch of each said arched side panel across portions of the rise and span of the arch of each of said arched side panels; and said frames being positioned in said container with said resilient membrane in face to face relationship for holding an object suspended therebetween.

2. A package according to claim 1 wherein said resilient membrane comprises a sheet of flexible plastic film.

3. A package according to claim 1 wherein each of said frames includes said arched side panels and wherein said arched side panels in one of said frames are positioned perpendicularly to said arched side panels in the other said frame in said container.

4. A package according to claim 1 wherein said container comprises a solid rectangle.

5. A package according to claim 1 wherein said side panels of each said frame form a rectangle.

6. A package according to claim 1 wherein said frames overlap one another in their face to face relationship in said container so that the respective resilient membranes can wrap an object suspended therebetween.

7. A package according to claim 1 wherein said frames have different dimensions from one another.

8. A package according to claim 7 wherein each of said frames includes said arched side panels and wherein said frames differ in length along said arched sides.

9. A package according to claim 1 wherein said frames further comprise spacer feet for abutting the walls of said container, Said spacer feet extending perpendicularly from at least one side panel at the edge of said side panel opposite the edge of said side panel from which said resilient membrane extends perpendicularly.

10. A package according to claim 2 wherein said container and said parallel sides of said frames are corrugated board.

11. A package according to claim 10 wherein said plastic film is selected from the group consisting of polyurethane and polyvinyl chloride.

12. A suspension frame for packaging fragile objects and comprising:

a plurality of upright side panels;

at least two of said side panels being parallel and each of which defines an arch therein so that said arched parallel side panels are opposite one another, and a resilient membrane attached tightly to said side panels of said frame, and extending from the base of the arch of each said arched side panel across portions of the rise and span of the arch of each of said arched side panels.

13. A suspension frame according to claim 12 wherein said resilient membrane comprises a sheet of flexible plastic film.

14. A suspension frame according to claim 12 wherein said side panels form a rectangle.

15. A suspension frame according to claim 12 wherein said frame further comprises spacer feet for abutting the walls of said container, said spacer feet extending perpendicularly from at least one side panel at the edge of said side panel opposite the edge of said side panel from which said resilient membrane extends perpendicularly.

16. A suspension frame according to claim 13 wherein said side panels of said frames are corrugated board.

17. A suspension frame according to claim 16 wherein said plastic film is selected from the group consisting of polyurethane and polyvinyl chloride.

18. A suspension frame blank for forming a suspension frame for packaging fragile objects, said blank comprising:

a substantially rectangular planar sheet of corrugated board;

fold lines in said sheet for defining four flap precursor portions along the four edges of said rectangular sheet;

a central opening defined by said corrugated board sheet, said opening having two parallel side portions and two opposing curved end portions; and a sheet of flexible plastic film covering said central opening and attached to said planar corrugated board sheet.

19. A suspension frame blank according to claim 18 wherein said parallel side portions of said opening are positioned adjacent two of said fold lines, and wherein said curved end portions extend beyond two of said fold lines.

20. A suspension frame blank according to claim 18 and further comprising a plurality of scored tab precursor patterns formed of respective fold lines and cut lines for forming tabs that hold said blank as a suspension frame when said blank is folded and said tabs are detached along said cut lines and folded.

21. A suspension frame blank according to claim 18 wherein said plastic film is selected from the group consisting of polyurethane and polyvinyl chloride.

22. A suspension frame blank according to claim 18 wherein said corrugated board comprises a corrugated kraft paper sheet lined on each side with flat kraft paper.

* * * * *